United States Patent [19]

McIlwain

[11] Patent Number: 4,478,534

[45] Date of Patent: Oct. 23, 1984

[54] FLOOD CONTROL SYSTEM

[76] Inventor: Ivy McIlwain, 201 Bryat St., NW., Washington, D.C. 20001

[21] Appl. No.: 250,936

[22] Filed: Apr. 7, 1981

[51] Int. Cl.³ ..... E02B 7/20; E02B 7/26; E02B 7/36

[52] U.S. Cl. ..... 405/96; 405/92; 405/104; 405/106

[58] Field of Search ..... 405/87, 92, 96, 97, 405/103, 104, 106, 107, 105, 91, 52, 81

[56] References Cited

U.S. PATENT DOCUMENTS

| | | | |
|---|---|---|---|
| 247,030 | 9/1881 | Edwards | 405/92 |
| 2,434,457 | 1/1948 | Cruikshank | 405/107 |
| 3,354,655 | 11/1967 | Armond | 405/104 X |
| 4,167,358 | 9/1979 | Besha | 405/87 |
| 4,252,461 | 2/1981 | Colamussi et al. | 405/91 X |
| 4,310,262 | 1/1982 | Calza et al. | 405/87 |

FOREIGN PATENT DOCUMENTS

| | | | |
|---|---|---|---|
| 1265063 | 3/1968 | Fed. Rep. of Germany | 405/91 |
| 608876 | 5/1978 | U.S.S.R. | 405/87 |

*Primary Examiner*—Dennis L. Taylor
*Assistant Examiner*—Nancy J. Stodola
*Attorney, Agent, or Firm*—Shoemaker and Mattare, Ltd.

[57] ABSTRACT

A system for controlling and preventing flooding of areas adjacent a waterway includes a multiplicity of interconnected flood gates located in the banks of the waterway. The system includes water level sensors and devices for moving the floodgates in response to signals from the water level sensors.

1 Claim, 5 Drawing Figures

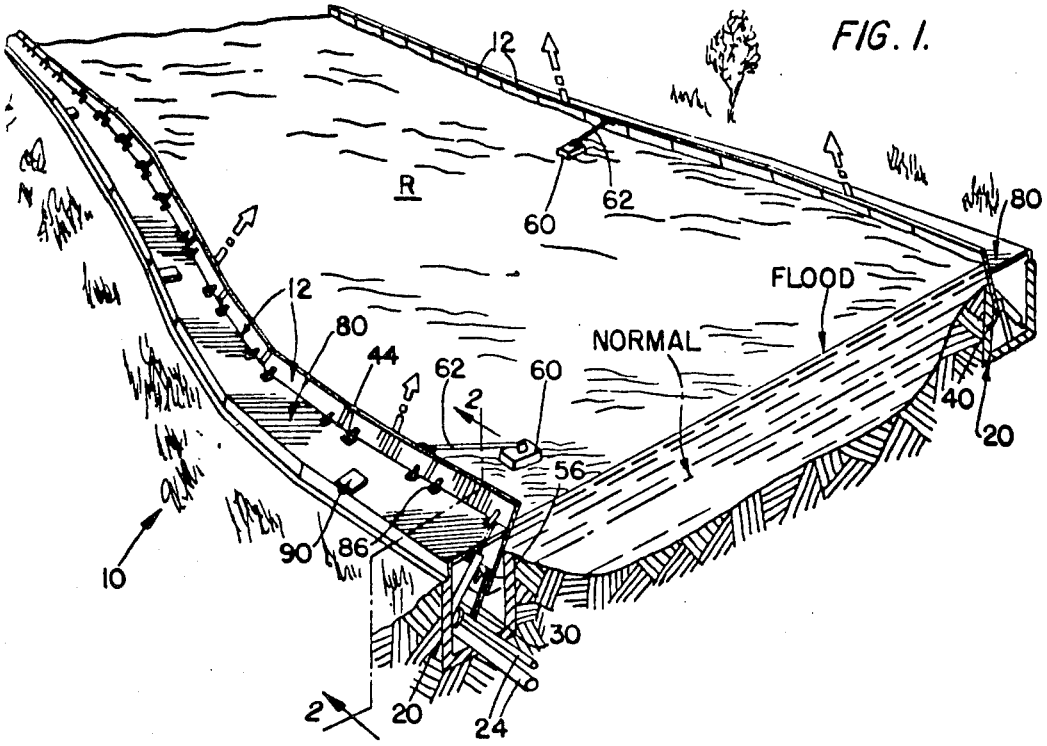
FIG. 1.
FIG. 2.
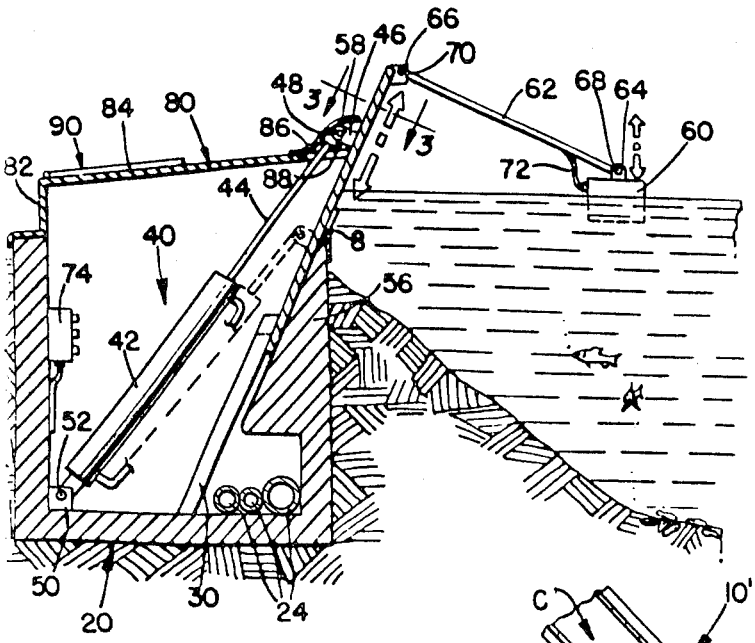
FIG. 3.
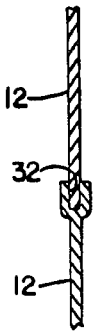
FIG. 4.
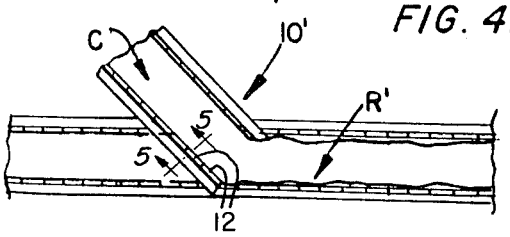

FLOOD CONTROL SYSTEM

BACKGROUND OF THE INVENTION

The present invention relates in general to flood control, and, more particularly, to automatic flood control means.

Flooding of rivers, such as the Mississippi River, or the like, has always been a great concern for those living in the proximity of such rivers. Historically, in response to flood conditions, sandbags, or the like, have been manually located next to the river in an attempt to contain the waters of the river. Such methods have many drawbacks, not the least of which is the slow rate at which sandbags can be placed relative to the rise in water level.

Dams and reservoirs are other means of flood control which have been used. However, these means have proven to be effective in only certain specific conditions.

There is thus a need for a means for controlling or preventing the flooding of surrounding areas by any and all waterways, such as rivers, or the like.

SUMMARY OF THE INVENTION

The device embodying the teachings of the present invention can be used adjacent any waterway and can be sized to accommodate any degree of water level rise expected to occur in such waterway. Preferably, the device disclosed herein is used adjacent rivers.

The device includes a multiplicity of floodgates movably mounted in housings along the path of the waterway. The floodgates are raised in response to a rising water level, and lowered when the water level falls. The floodgates are raised when water reaches a predetermined level, and the rise is continuous thereafter as the water continues to rise. The raising of the gates ceases when the water level ceases rising. The gates then automatically lower as the water level lowers.

The water is controlled automatically and nearly instantaneously. Thus, there is no need to anticipate a flood situation and alert volunteers or the like.

The device used to control the raising and lowering of the floodgates can also trigger alarms and all clear signals to notify residents living near the danger zone. Thus, as a crest passes down a river, those floodgates will be raised and others lowered, while some evacuation alarms are sounded while other all clear signals are given.

OBJECTS OF THE INVENTION

It is a main object of the present invention to automatically prevent flooding of areas surrounding a waterway.

It is another object of the present invention to automatically prevent flooding of areas located adjacent a river.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 1 is a perspective showing a river having a flood control device embodying the teachings of the present invention.

FIG. 2 is a view taken along line 2—2 of FIG. 1.

FIG. 3 is a view taken along line 3—3 of FIG. 2.

FIG. 4 is a schematic looking down from above of an alternative embodiment of the device embodying the teachings of the present invention.

DETAILED DESCRIPTION OF THE INVENTION

Figure 5:
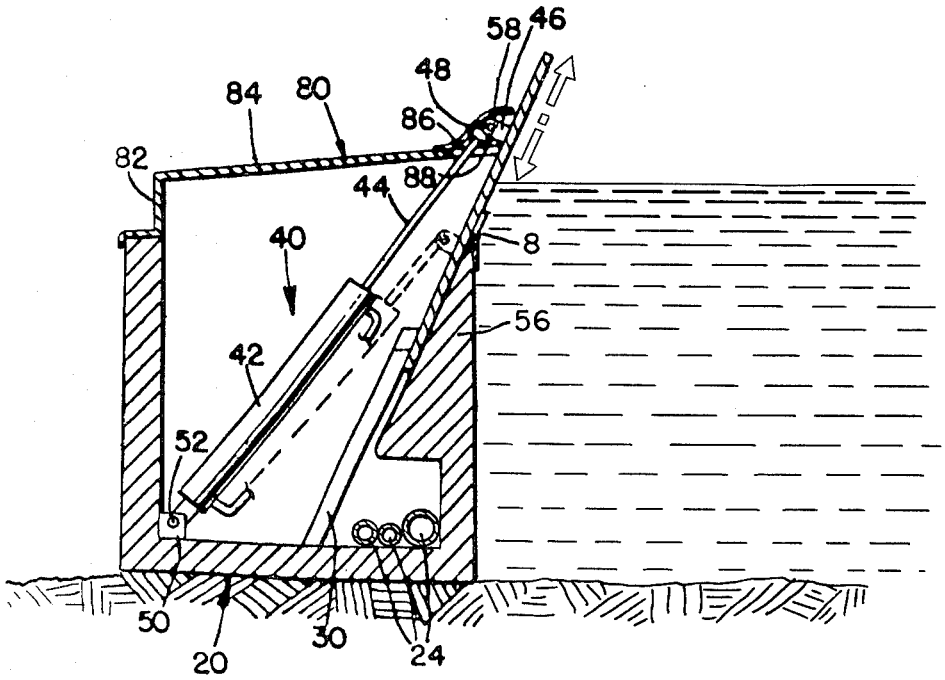
FIG. 5 is a cross-sectional view similar to FIG. 2 showing the housing and floodgates for mounting on the river bed.

Shown in FIG. 1 is a flood prevention means 10 embodying the teachings of the present invention. The flood control means includes a multiplicity of interlocked floodgates 12 which are movably mounted adjacent a body of water, such as a river R, or the like, which is subject to flooding the area bordering that body of water.

The floodgates are mounted in housings 20 which are buried next to the body of water on both banks thereof. The housings preferably are located beneath the normal water level, and preferably follow the general path of the body of water for a substantial length of that body of water. Thus, for example, if the river is subject to flooding over a certain stretch, flood prevention means 10 is located along that stretch. Such stretch can include the entire length of the river, if necessary.

The housings are formed of concrete, preferably reinforced, and are constructed and sealed to prevent leakage thereinto, or movement thereof due to hydrostatic pressure within the ground.

The housings form work and monitoring chambers for personnel in control of the flood prevention means, and control conduits 24 are located within the housings for water, electricity, and the like.

Preferably, the floodgates are planar, but can be arcuate without departing from the scope of this disclosure. The endmost floodgates, and, if suitable, selected other floodgates, are mounted in edge guides 30, and all floodgates are mounted on some sort of guide. As shown in FIG. 3, the floodgates each have one side edge thereof bifurcated to define a channel 32 and the side edge of the adjoined floodgate is received in that channel to interlock adjacent floodgates together.

The floodgates are raised and lowered by means such as hydraulic means 40. A pair of hydraulic means is associated with each floodgate as shown in FIG. 1. Each hydraulic means includes a cylinder 42 and an arm 44 coupled to the floodgate by bracket 46 and pin 48. The cylinder is pivotally mounted at one end thereof to a mounting anchor bracket 50 by a pivot pin 52. Suitable hydraulic lines and pumps are also included, but are not shown.

As best shown in FIG. 2, one wall 56 of the housing is inclined toward the body of water and serves as a guide and mount for the floodgates. A seal 58 is mounted on this wall to prevent leakage between the floodgate and this wall into the housing.

A floodgate control system includes floats 60 located at suitable positions along the path of the waterway. Each float is attached to a floodgate by a float arm 62, brackets 64 and 66 and pivot pins 68 and 70. A control cable 72 connects the float to a control panel 74, and the position of the float relative to a reference position is fed to that control panel. Using the floats, the height of the body of water relative to the river bed, or some other convenient reference, can be monitored so that the floodgates can be raised and lowered in accordance with flood conditions of the body of water to thereby contain the water within the banks of the body of water, thereby preventing flooding of the adjacent areas.

A roof 80 can be included with the housing, and includes a base 82 mounted on one wall of the housing and a cover section 84 abutting the flood gates. Seals 86 cover holes 88 through which the hydraulic arms reach the floodgates. Access means 90 are defined in the roof through which personnel can enter and leave the building, equipment can be brought into the building, or the like.

The operation of the flood control device is evident from the above discussion and is keyed when the water in the body of water rises above a normal level. The floats rise with the water, and when the water reaches a certain level, the hydraulic cylinders are actuated to raise the floodgates. As the water continues to rise, so do the floodgates. The upward movement of the floodgates is indicated in FIG. 2. As the water level recedes, the floats key the control system which lowers the floodgates accordingly. The automatic operation can be overridden manually, if necessary.

FIG. 4 shows an alternative embodiment 10' wherein the floodgates are shown in the raised position and positioned across a river to divert that river into a secondary channel C. When the floodgates are retracted the flow of the water will continue along the river. The housings, the floodgates and the like in the embodiment 10' are identical to those elements in the means 10. The operation of the embodiment 10' is also identical and keyed to keeping the river diverted as well as to flood control and prevention. The level of water in the river R' downstream of the embodiment 10' can also be carefully controlled using the floodgates of this embodiment. The embodiment 10' can thus function as a dam as well as a diverter and flood control device.

When the waterway is a river, the flood prevention and control means can extend along that river for a distance sufficient to prevent flooding of certain areas, while permitting the flooding of other areas, if suitable. In this manner, areas needing flood water can be assured of getting such water, while areas, such as metropolitan areas, are protected. If need be, substantially the entire length of a river can be controlled using the means diclosed herein.

The means 10 and 10' can be used in conjunction with each other to control and divert a river, or other such waterway.

FIG. 5 which is basically the same structure as shown in FIGS. 1 and 2, depicts the housing and floodgate structure for the embodiment 10' wherein the floodgates function as a dam as well as a diverter and flood control device. This structure is taken along line 5—5 of FIG. 4 and shows the hydraulic means 40' which include the pairs of hydraulic cylinders 42' appropriately connected by arms 44', brackets 46', and pins 48' for effecting the raising and lowering of the floodgates 12'. The primary difference between the structure depicted in FIG. 5 and that of FIG. 2 is that the float structure 60 is omitted therefrom. In other words, this structure corresponds to the sections of the floodgates and housing as shown along the banks in FIG. 1, which are not provided with the float 60 and lever mechanism actuated thereby. Of course, the housing 20' will rest upon the original river bed of river R'.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A flood control and waterway diverting means comprising:

housings embedded in banks along both sides of a portion of a waterway and further housings embedded in both sides of banks along a portion of a second waterway which second waterway intersects said first waterway, a substantial portion of said housings being located beneath the normal water level of the waterways;

a multiplicity of floodgates mounted in said housings to move up and down for containing water in both waterways;

some of said floodgates spanning said first waterway for diverting at least a portion of the water from said first waterway into said second waterway when they are activated;

interlocking means on each of said floodgates for connecting a floodgate to an adjacent floodgate;

floodgate hydraulic moving means for moving said floodgates up and down; and water level sensing float means connected to said floodgate hydraulic moving means for actuating said hydraulic moving means when water in said waterway reaches a predetermined level.

* * * * *

UNITED STATES PATENT AND TRADEMARK OFFICE

CERTIFICATE OF CORRECTION

PATENT NO. : 4,478,534

DATED : October 23, 1984

INVENTOR(S) : IVY McILWAIN

It is certified that error appears in the above-identified patent and that said Letters Patent is hereby corrected as shown below:

On the title page;

Please change Patentee's address to read:

97 Hawaii Avenue, N. E.
Washington, D.C. 20011

Signed and Sealed this

*Ninth* Day of *July 1985*

[SEAL]

*Attest:*

DONALD J. QUIGG

*Attesting Officer*

*Acting Commissioner of Patents and Trademarks*